US008009133B2

(12) United States Patent
You

(10) Patent No.: US 8,009,133 B2
(45) Date of Patent: Aug. 30, 2011

(54) DISPLAY DEVICE AND METHOD OF OPERATING THE DISPLAY DEVICE TO CHANGE LUMINANCE DURING A SELECTED PORTION OF A FRAME

(75) Inventor: Bong-Hyun You, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 790 days.

(21) Appl. No.: 11/850,419

(22) Filed: Sep. 5, 2007

(65) Prior Publication Data

US 2008/0062103 A1 Mar. 13, 2008

(30) Foreign Application Priority Data

Sep. 7, 2006 (KR) ..... 10-2006-0085949

(51) Int. Cl.
*G09G 3/36* (2006.01)

(52) U.S. Cl. ..... 345/90

(58) Field of Classification Search ..... 345/87–95, 345/104, 204, 690, 210
See application file for complete search history.

(56) References Cited

U.S. PATENT DOCUMENTS

| | | | | |
|---|---|---|---|---|
| 3,862,360 | A * | 1/1975 | Dill et al. | 348/792 |
| 6,909,415 | B2 * | 6/2005 | Kumagawa et al. | 345/92 |
| 2006/0176255 | A1 * | 8/2006 | Do et al. | 345/87 |
| 2006/0268186 | A1 * | 11/2006 | Kamada et al. | 349/38 |

* cited by examiner

*Primary Examiner* — Kevin Nguyen
*Assistant Examiner* — Liliana Cerullo
(74) *Attorney, Agent, or Firm* — Innovation Counsel LLP

(57) ABSTRACT

A display panel includes a first switching element, a liquid crystal capacitor and a second switching element. The first switching element receives a gate signal and a data signal. The liquid crystal capacitor is connected to the first switching element, and charged with an initial pixel voltage corresponding to the data signal. The second switching element operates in response to a compensation gate signal applied from a compensation gate line. The compensation capacitor is connected to the second switching element to reduce the liquid crystal capacitor's voltage to a value below the initial pixel voltage when the second switching element is turned on. Accordingly, motion blur can be reduced or eliminated.

18 Claims, 7 Drawing Sheets

DISPLAY DEVICE AND METHOD OF OPERATING THE DISPLAY DEVICE TO CHANGE LUMINANCE DURING A SELECTED PORTION OF A FRAME

CROSS-REFERENCE TO RELATED APPLICATIONS

This application claims priority to Korean Patent Application No. 2006-85949 filed on Sep. 7, 2006, the contents of which are herein incorporated by reference in their entirety.

BACKGROUND OF THE INVENTION

1. Field of the Invention

The present invention relates to a display panel, a display device having the display panel, and a method of operating the display device. More particularly, the present invention relates to a display panel capable of improving the display quality of a moving image, to a display device having such a display panel, and to a method of operating the display device.

2. Description of the Related Art

Generally, a liquid crystal display (LCD) device includes a display panel (i.e, an LCD panel) and a backlight providing the LCD panel with light. The LCD panel includes an array substrate and an opposite substrate facing each other, and a liquid crystal layer interposed between the two substrates. The LCD device displays images in a sample-and-hold manner, as opposed to a cathode ray tube (CRT) device that displays images as an impulse device. Accordingly, motion blur may occur when displaying a high-speed moving image on the LCD. The motion blur occurs because the image of the preceding frame remains on the display for some time while the next frame is being readied. To solve the motion blur problem, the LCD can be overdriven, i.e. driven with higher voltages to improve the liquid crystal's response speed. However, the motion blur may still be present in spite of the improved response speed.

SUMMARY

Some embodiments of the present invention obviate the above problems to provide a display panel having a pixel structure capable of improving the display quality of a moving image.

The present invention also provides a display device having the display panel.

The present invention also provides a method of operating a display device.

In a display device according to an exemplary embodiment of the present invention and achieve the above-mentioned purpose, a display panel comprises: a first switching element for receiving a gate signal from a gate line and for receiving a data signal from a data line; a liquid crystal capacitor connected to the first switching element, for being charged with an initial pixel voltage corresponding to the data signal; and a voltage lowering part that lowers a voltage of the liquid crystal capacitor to lower a luminance of an image pixel in response to a compensation gate signal provided by a compensation gate line.

A display device according to an exemplary embodiment of the present invention comprises a display panel comprising: a first switching element including two first input terminals and a first output terminal, the two first input terminals being connected to a gate line and a data line respectively; a liquid crystal capacitor including a driving electrode and a common electrode, the driving electrode being connected to the first output terminal of the first switching element; a compensation capacitor connected in parallel with the liquid crystal capacitor; a second switching element including two second input terminals and a second output terminal, the two second input terminals being connected to the compensation capacitor and a compensation gate line respectively, and the second output terminal being connected to the common electrode of the liquid crystal capacitor; a source driving block for outputting a data signal to the data line; a gate driving block for outputting a gate signal to the gate line; a compensation gate driving block for outputting a compensation gate signal to the compensation gate line with a delay relative to the gate signal.

Some embodiments of the present invention provide a method of driving a display device including a display panel comprising a first switching element including two first input terminals connected respectively to a gate line and a data line, a liquid crystal capacitor including a driving electrode connected to a first output terminal of the first switching element, a compensation capacitor connected in parallel with the liquid crystal capacitor, and a second switching element including two second input terminals connected respectively to the compensation capacitor and a compensation gate line and including a second output terminal connected to a common electrode of the liquid crystal capacitor, the method comprising: outputting a data signal to the data line; outputting a gate signal to the gate line; and outputting a compensation gate signal to the compensation gate line with a delay relative to the gate signal.

In some embodiments, motion blur can be reduced or eliminated via reducing the liquid crystal capacitor's voltage from an initial pixel voltage value to a compensation pixel voltage value in response to a compensation gate signal applied to a compensation gate line.

BRIEF DESCRIPTION OF THE DRAWINGS

The above and other features and advantages of some embodiments of the present invention will become more apparent in view of detailed description of exemplary embodiments thereof with reference to the accompanying drawings, in which.

DESCRIPTION OF SOME EMBODIMENTS

Figure 1:
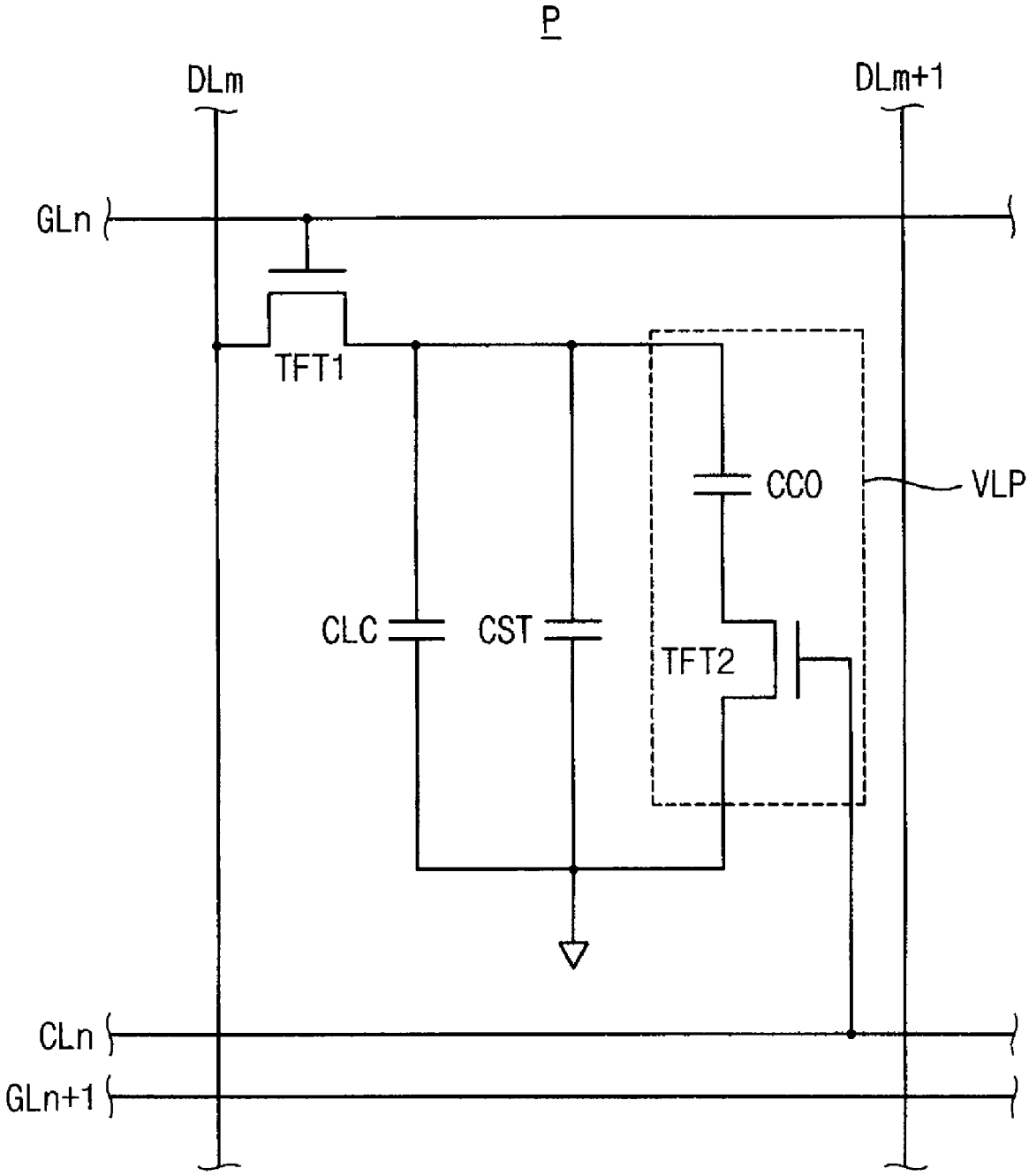
FIG. 1 is a circuit diagram of a display panel according to an exemplary embodiment of the present invention.

Some embodiments of the present invention will now be described with reference to the accompanying drawings. The invention may, however, be embodied in many different forms and should not be construed as limited to the embodiments set forth in this section; rather, these embodiments are provided to make this disclosure thorough and complete, and to fully convey the scope of the invention to those skilled in the art. It will be understood that when an element is referred to as being "on" or "onto" another element, it may be directly on the other element or intervening elements may also be present. In contrast, when an element is referred to as being "directly on" another element, there are no intervening elements present. Like reference numerals refer to similar or identical elements throughout.

FIG. 1 is a circuit diagram of a display panel according to an exemplary embodiment of the present invention. The display panel includes a plurality of pixel structures. For example, the pixel structure may be defined by a plurality of data lines and a plurality of gate lines arranged transversely to the data lines. The area of each pixel structure 'P' is defined by adjacent m-th and m+1-th data lines DLm, DLm+1 and adjacent n-th and n+1-th gate lines GLn, GLn+1. An n-th compensation gate line passes through this area. The n-th compensation gate line CLn is parallel to the n-th gate line GLn.

The pixel structure 'P' includes a first switching element TFT1, a liquid crystal capacitor CLC, a storage capacitor CST and a voltage lowering part VLP.

The first switching element TFT1 includes two first input terminals connected to the n-th gate line GLn and the m-th data line DLm respectively, and a first output terminal connected to a first driving electrode of the liquid crystal capacitor CLC.

The first input terminals of the first switching element TFT1 may be a first gate electrode and a first source electrode. The first output terminal of the first switching element TFT1 includes a first drain electrode. The first gate electrode is connected to the n-th gate line GLn, and the first source electrode is connected to the m-th data line DLm. The first drain electrode is connected to the first driving electrode ("pixel electrode") of the liquid crystal capacitor CLC, to a driving electrode ("second driving electrode") of the storage capacitor CST, and to a driving electrode ("third driving electrode") of the compensation capacitor CCO.

The liquid crystal capacitor CLC includes the first driving electrode ("pixel electrode") connected to the first drain electrode, a first common electrode facing the pixel electrode, and a liquid crystal layer (not shown) interposed between the pixel electrode and the first common electrode.

The storage capacitor CST includes a second driving electrode (hereinafter, "storage electrode") and a second common electrode facing the storage electrode.

The compensation capacitor CCO includes the third driving electrode (hereinafter "compensation electrode") and a third common electrode facing the compensation electrode. The third common electrode is connected to the second switching element TFT2.

The voltage lowering part VLP includes a compensation capacitor CCO and a second switching element TFT2.

The second switching element TFT2 includes two second input terminals connected to the compensation capacitor CCO and the n-th compensation gate line CLn respectively, and a second output terminal connected to the first common electrode of the liquid crystal capacitor CLC. For example, the second input terminals of the second switching element TFT2 may be a second gate electrode and a second source electrode. The second output terminal of the second switching element TFT2 includes a second drain electrode. The second gate electrode is connected to the n-th compensation gate line CLn, and the second source electrode is connected to the third common electrode of the compensation capacitor CCO. The second drain electrode is connected to the first common electrode.

Figure 2:
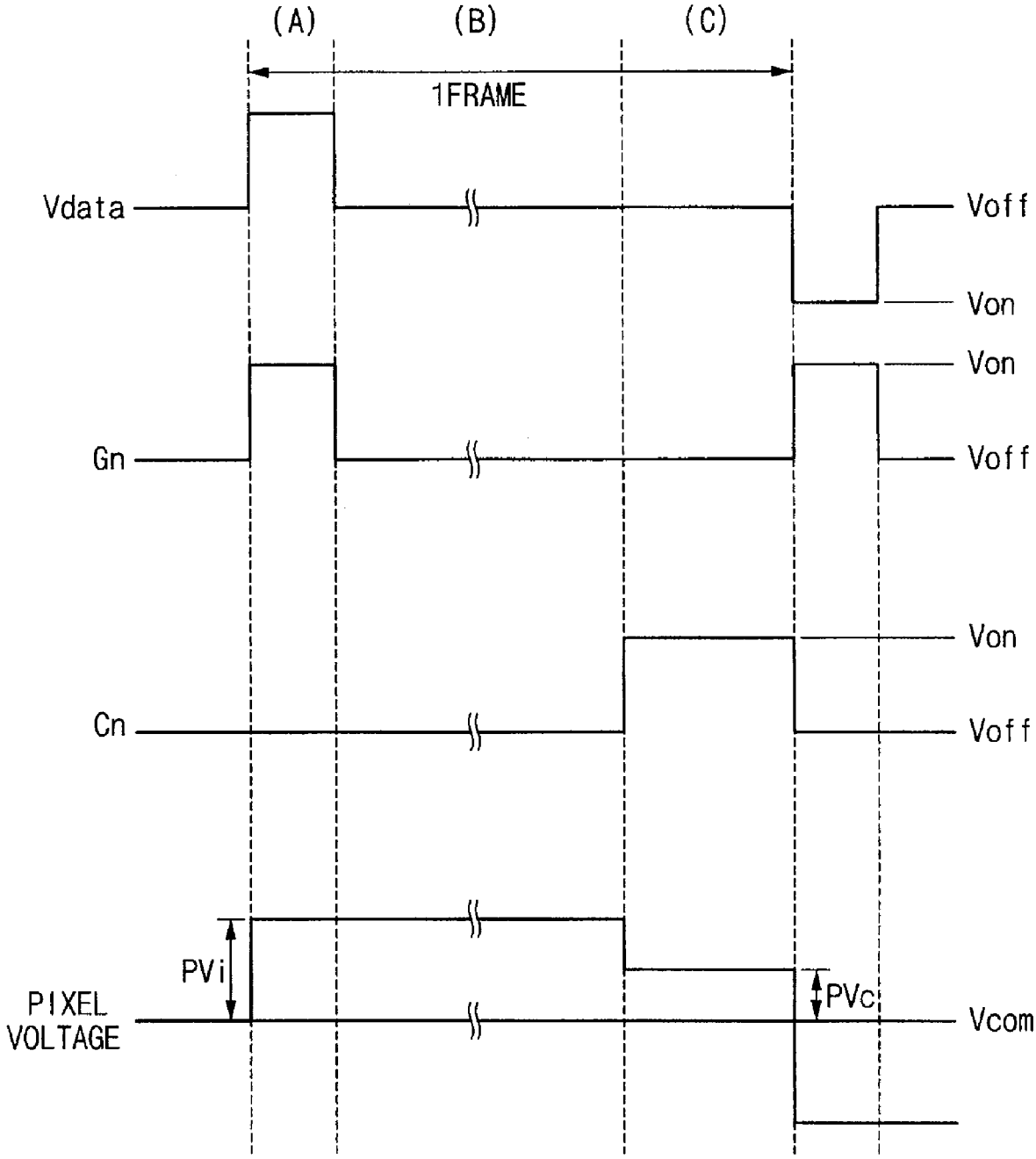
FIG. 2 is a timing diagram showing input signals of the circuit of FIG. 1.
Figure 3A:
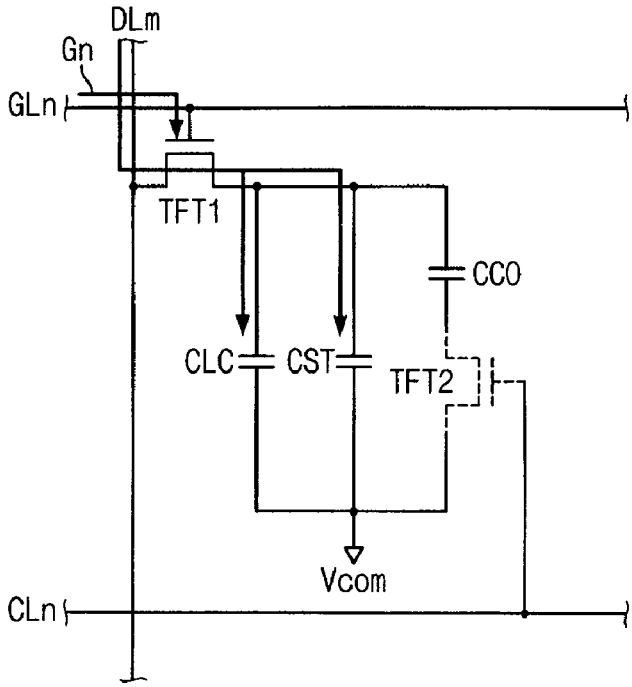
FIGS. 3A, 3B and 3C are schematic diagrams illustrating the operation shown in the timing diagram of FIG. 2.
Figure 3B:
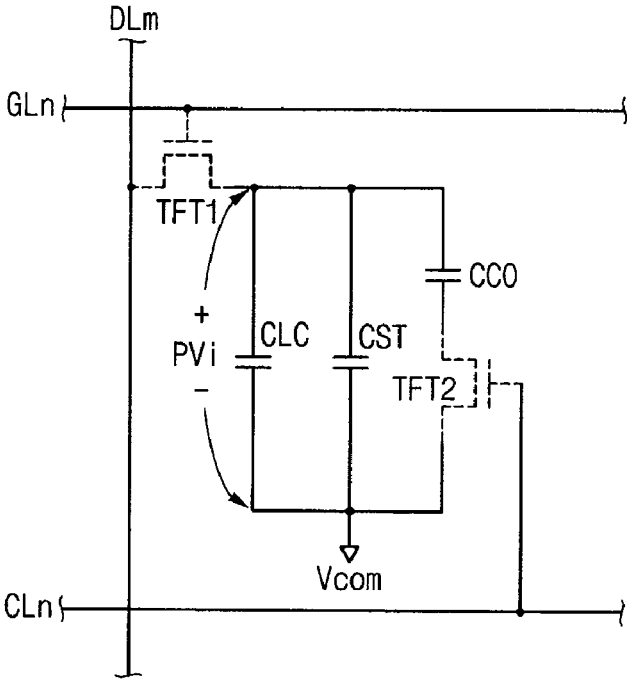
Figure 3C:
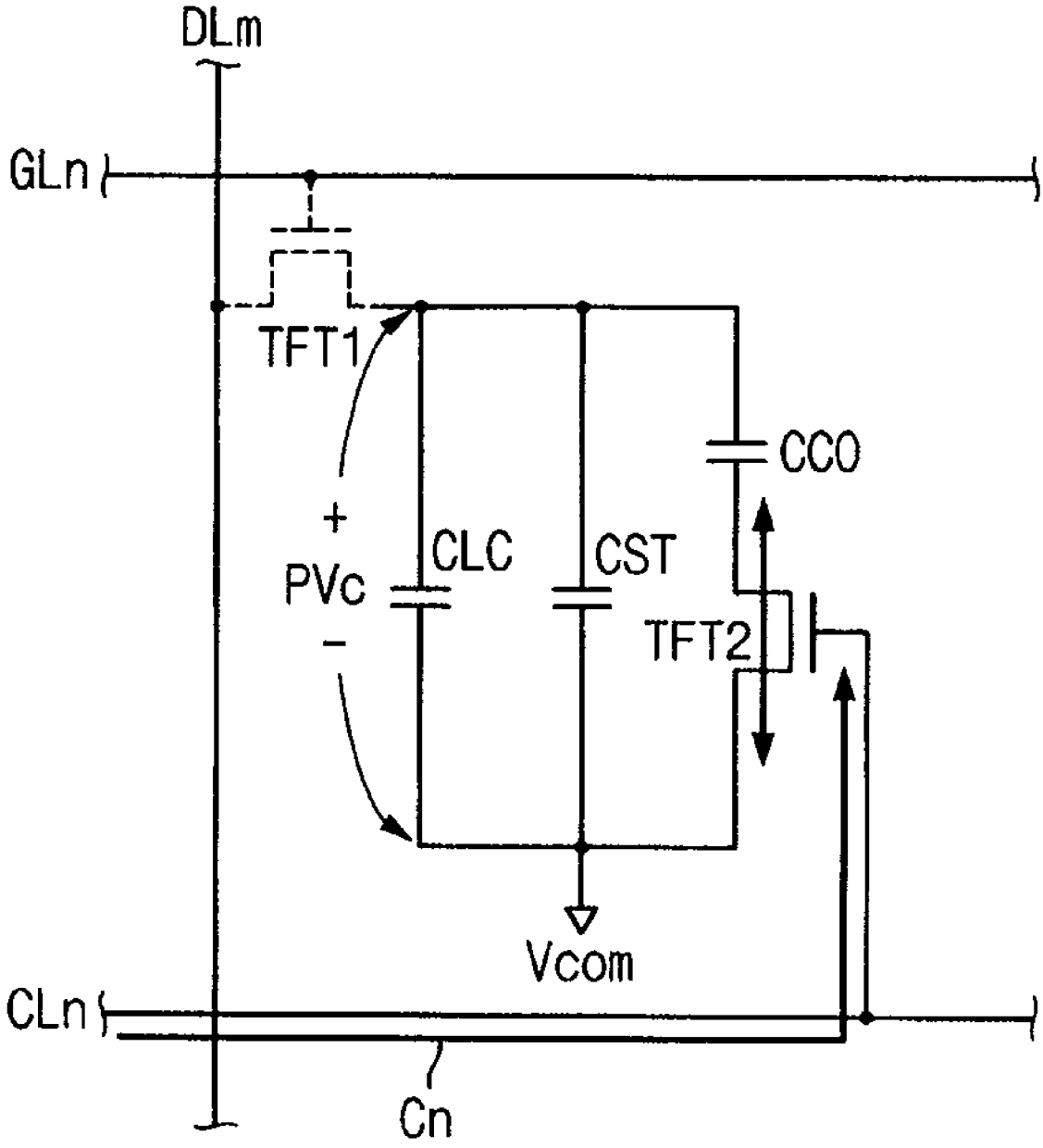

FIG. 2 is a timing diagram showing input signals for the circuit of FIG. 1. FIGS. 3A, 3B and 3C explain the operation according to the timing of FIG. 2.

Referring to FIGS. 2 and 3A, an initial pixel voltage PVi charges the liquid crystal capacitor CLC and the storage capacitor CST in a first portion 'A' of a frame period 1FRAME (the frame period 1FRAME in FIG. 3A is shown as the period between the rising edges of gate signal Gn). This is done as follows in some embodiments. Gate signal Gn, which is a gate-on voltage Von, is applied to the n-th gate line GLn. As a result, the gate signal Gn is applied to the first gate electrode of the first switching element TFT1 to turn on the first switching element TFT1. When the first switching element TFT1 turns on, a data voltage Vdata provided on the m-th data line DLm is applied to the liquid crystal capacitor CLC and the storage capacitor CST.

Compensation gate signal Cn is not applied to the n-th compensation gate line CLn at this time. Rather, a gate-off voltage Voff is applied to the n-th compensation gate line CLn. Accordingly, the second switching element TFT2 is off, and the compensation capacitor CCO's electrode electrically connected to the second switching element TFT2 is in a floating state.

Due to the data voltage Vdata and a common voltage Vcom applied to the liquid crystal capacitor CLC and the storage capacitor CST, the two capacitors store an electric charge corresponding to the voltage difference between the data voltage Vdata and the common voltage Vcom. This voltage difference is shown as the initial pixel voltage PVi.

Referring to FIGS. 2 and 3B, the initial pixel voltage PVi is maintained on the liquid crystal capacitor CLC and the storage capacitor CST during a second portion 'B' of the frame period 1FRAME. More particularly, at the end of the first portion 'A' of the frame period 1FRAME, the gate-off voltage Voff is applied to the n-th gate line GLn to turn off the first switching element TFT1. Also, the n-th compensation gate line CLn is kept at the gate-off voltage Voff to keep the second switching element TFT2 off. Therefore, the initial pixel voltage PVi provided in the first portion 'A' of the frame period 1FRAME is maintained on the liquid crystal capacitor CLC and the storage capacitor CST.

Referring to FIGS. 2 and 3C, the voltage on the liquid crystal capacitor CLC and the storage capacitor CST decreases in a third portion 'C' of the frame period 1FRAME. In one example, the n-th gate line GLn is kept at the gate-off voltage Voff to keep the first switching element TFT1 off. In contrast, the n-th compensation gate line CLn is driven with the compensation gate signal Cn equal to the gate-on voltage Von. The compensation gate signal Cn is thus applied to the second gate electrode of the second switching element TFT2 through the n-th compensation gate line CLn to turn on the second switching element TFT2. When the second switching element TFT2 turns on, the compensation capacitor CCO becomes connected in parallel with the liquid crystal capacitor CLC and the storage capacitor CST. Accordingly, some of the charge stored on the liquid crystal capacitor CLC and the storage capacitor CST flows to the compensation capacitor CCO. Consequently, the voltage on the liquid crystal capacitor CLC and the storage capacitor CST decreases from the initial pixel voltage value PVi to a compensation pixel voltage value PVc when the second switching element TFT2 is turned on.

Therefore, the pixel structure 'P' is charged to the initial pixel voltage PVi in the first and second portions 'A' and 'B' of the frame period 1FRAME, and to the compensation pixel voltage PVc proportional to the initial pixel voltage PVi in the third portion 'C' of the frame period 1FRAME.

Figure 4:
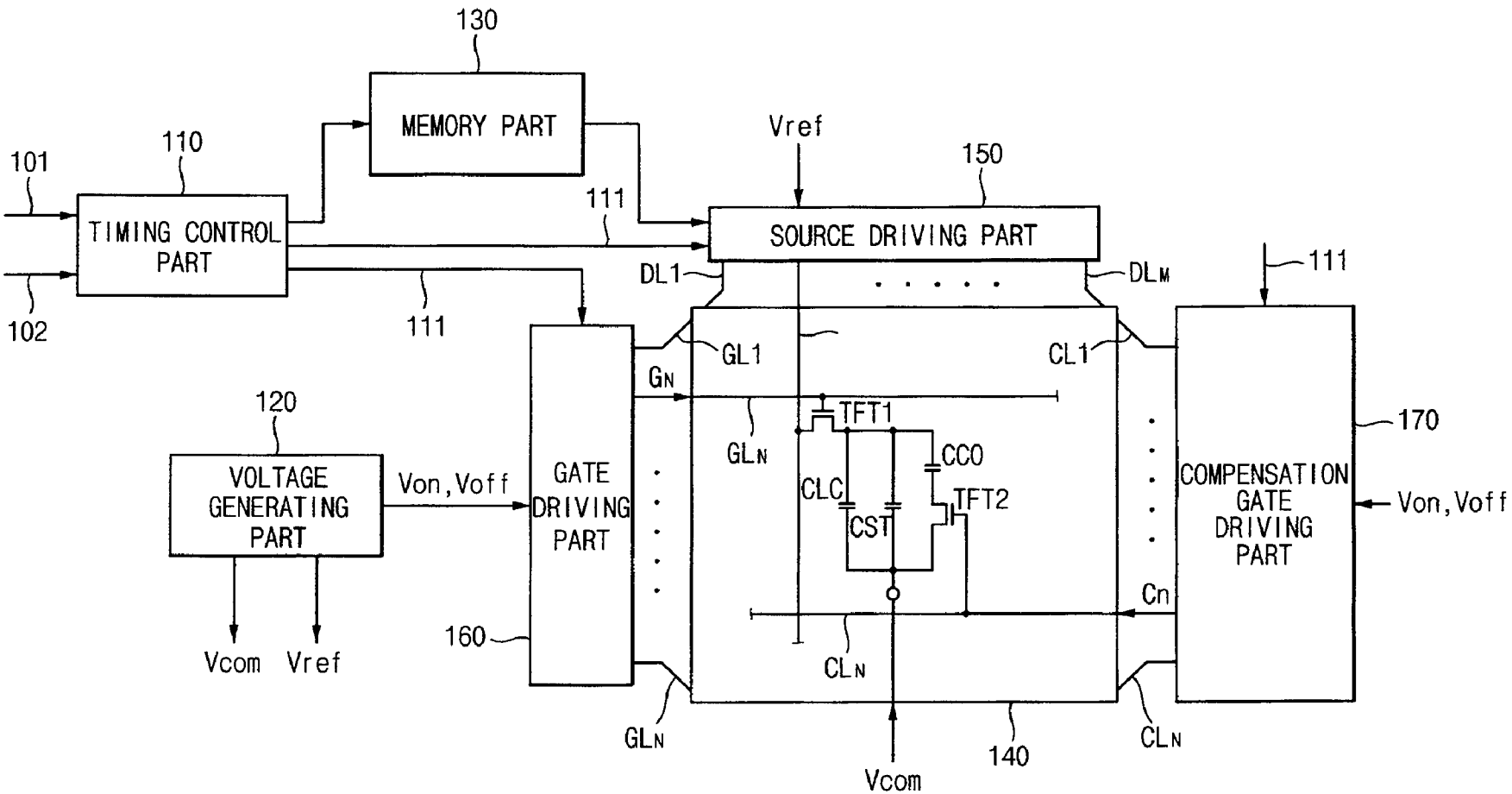
FIG. 4 is a block diagram of a display device according to an exemplary embodiment of the present invention.

FIG. 4 is a block diagram of a display device according to another exemplary embodiment of the present invention. The display device of FIG. 4 includes a timing control block 110, a voltage generating block 120, a memory block 130, a display panel 140, a source driving block 150, a gate driving block 160 and a compensation gate driving block 170.

The timing control block 110 generates a driving control signal 111 based on a primary control signal 101 received from an external graphics controller (not shown), and controls the operation of the display device using the driving control signal 111.

The voltage generating block 120 generates operating voltages for operating the display device. The operating voltages may include voltage Vcom provided to the display panel 140, a reference gradation voltage Vref provided to the source driving block 150, and gate on/off voltages Von and Voff that are provided to the gate driving block 160 and the compensation gate driving block 170.

The memory block 130 stores and provides data received by the display device. The data are written to, and read out from, the memory block 130 at predetermined equal intervals of time (equal to a frame period for example) under the control of the timing control block 110.

The display panel 140 includes a plurality of data lines $DL_1, \ldots, DL_M$, a plurality of gate lines $GL_1, \ldots, GL_N$, and a plurality of compensation gate lines $CL_1, \ldots, CL_N$ parallel to the gate lines $GL_1, \ldots, GL_N$.

The display panel 140 includes a plurality of pixel structures 'P'. Each pixel structure 'P' is as in FIG. 1. The pixel structure 'P' includes a first switching element TFT1, a liquid crystal capacitor CLC, a storage capacitor CST, a compensation capacitor CCO and a second switching element TFT2. Further description of the pixel structure 'P' is given above in connection with FIG. 1 and will not be repeated.

The source driving block 150 converts the data signals read out from the memory block 130 to analog data voltages under the control of the driving control signal 111, and outputs the analog data voltages to the data lines $DL_1, \ldots, DL_M$.

The gate driving block 160 generates a gate signal from the gate on/off voltages Von and Voff. The gate driving block 160 sequentially outputs the gate signal to the gate lines $GL_1, \ldots, GL_N$.

The compensation gate driving block 170 operates with a delay relative to the gate driving block 160. The compensation gate driving block 170 generates a compensation gate signal from the gate on/off voltages Von and Voff. The compensation gate driving block 170 sequentially outputs the compensation gate signal to the compensation gate lines $CL_1, \ldots, CL_N$.

Figure 5:
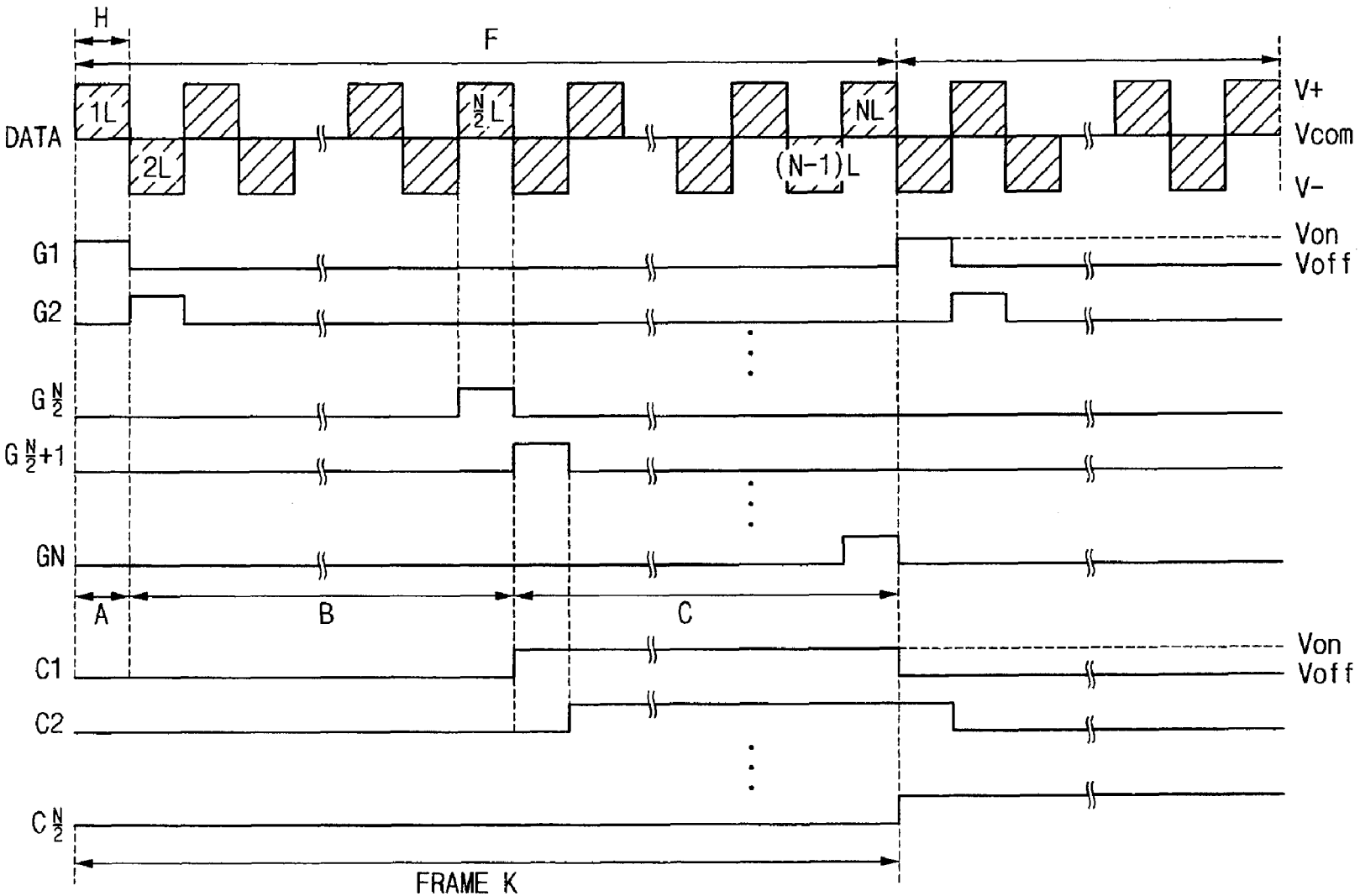
FIG. 5 is a timing diagram illustrating operation of a display device according to an exemplary embodiment of the present invention.

FIG. 5 is a timing diagram illustrating the operation of the display device of FIG. 4 according to an exemplary embodiment of the present invention.

Referring to FIGS. 4 and 5, the timing control block 110 receives primary control signal 101 and data 102, generates the driving control signal 111 based on the received primary control signal 101, and stores the received data in the memory block 130 at regular intervals of time each of which is equal to a frame period.

The timing control block 110 reads out the data for one horizontal line of pixels from the memory block 130 at regular intervals of time each of which is equal to a horizontal period, and outputs the data to the source driving block 150. The source driving block 150 converts the data for one horizontal line to analog data voltages, and outputs the analog data voltages to the data lines $DL_1, \ldots, DL_M$ of the display panel 140 during a horizontal period 'H' [DATA].

The gate driving block 160 generates gate signals $G_1, \ldots, G_N$ that have a first pulse width of a predefined length, possibly equal to one horizontal period 'H'. In FIG. 5, the time of generating the signal $G_1$ is shown as a first portion 'A' a frame period 'F' which begins at the rising edge of the gate signal $G_1$. Generally, each gate signal $G_i$ is generated during a first portion 'A' of a frame period which starts at the rising edge of the gate signal $G_i$. The gate signals are generated from the gate on/off voltages Von and Voff. The gate driving block 160 outputs the gate signals $G_1, \ldots, G_N$ to the respective gate lines $GL_1, \ldots, GL_N$.

In synchronization with the gate signals output from the gate driving block 160, the compensation gate driving block 170 outputs a first compensation gate signal C1 beginning at the end of a second portion 'B' of the frame period 'F'. The second portion 'B' begins at the end of the first portion 'A'.

The compensation gate driving block 170 generates compensation gate signals $C_1, \ldots, C_N$ from the gate on/off voltages Von and Voff, and sequentially outputs the compensation gate signals $C_1, \ldots, C_N$ to the compensation gate lines $CL_1, \ldots, CL_N$ at the start of the respective first portions 'A' of the respective frame periods 'F' which start at the rising edges of the respective gate signals $G_1, \ldots, G_N$. Each of the compensation gate signals $C_1, \ldots, C_N$ has a second pulse width equal in length to a third portion 'C' of the respective frame period 'F'. The second pulse width is longer than the first pulse width 'A'. In each third portion 'C', darker-than-normal image is displayed on the corresponding horizontal line to eliminate a motion blur that could be caused by a moving image displayed on the display panel 140. Therefore, the brightness of the moving image displayed in the display panel 140 can be controlled by adjusting the length of the third portions 'C'.

In the example of FIG. 5, the combined length of the first and second pulxe widths 'A' and 'B' is N/2*H. The data driven by the source driving block 150 are shown as "1L" for the first horizontal period 'H' in a frame display (i.e. for the first line of pixels, corresponding to the gate line G1), "2L" for the second horizontal period 'H', and so on. Thus, the source driving block 150 outputs line data voltages 1L to the data lines $DL_1, \ldots, DL_M$ in the first horizontal period 'H', data voltages 2L in the second horizontal period 'H', and so on. Data voltages NL are output in the N-th horizontal period H, where N is the total number of pixel rows of the display device 140.

The gate driving block 160 sequentially outputs the gate signals $G_1, \ldots, G_N$ for the respective line data voltages 1L, 2L, . . . , NL output from the source driving block 150. In the first N/2 horizontal periods 'H', the gate driving block 160 sequentially outputs the gate signals $G_1, \ldots, G_{N/2}$ on the respective N/2 gate lines. Accordingly, the first to N/2-th horizontal lines of pixels are charged with the initial pixel voltages corresponding to line data voltages 1L, 2L, . . . , (N/2)L. In particular, the first switching elements TFT1 of the pixel structures are turned on in response to the gate signals, and thus the liquid crystal capacitors CLC are charged with the initial pixel voltages corresponding to the respective line data voltages 1L, 2L, . . . , (N/2)L.

When the gate signal for the line (N/2)+1 is output from the gate driving block 160, the compensation gate driving block 170 outputs the first compensation gate signal C1 on the first compensation gate line CL1. Until then, the voltages on the first horizontal line were the initial pixel voltages, which charged the line in response to the first gate signal G1 during the second portion 'B' of the corresponding frame period. When the first compensation gate signal C1 is applied to the first compensation gate line CL1, the voltages on the first horizontal line decrease from the initial pixel voltages to the compensation pixel voltages in response to the first compensation gate signal C1.

The voltages on the first horizontal line are maintained at the compensation pixel voltage levels during the third portion 'C' of the frame period corresponding to the first horizontal line. The length of each time interval 'C' (each third portion of the frame period corresponding to a line) is equal to the second pulse width, which is the pulse width of the first compensation gate signal C1.

If the second pulse width 'C' is lengthened, the compensation pixel voltage is maintained longer, so the brightness of the image on the display panel 140 decreases. To the contrary, when the second pulse width 'C' is shortened, the compensation pixel voltage is maintained for a shorter time, so the brightness of the image on the display panel 140 increases. Therefore, the brightness can be controlled by adjusting the second pulse width 'C'.

As shown in FIG. 5, the compensation gate driving block 170 sequentially outputs the first to the N/2-th compensation gate signals $C_1, \ldots, C_{N/2}$ in synchronization with the (N/2)+1-st to the N-th gate signals $G_{(N/2)+1}, \ldots, G_N$ that are sequentially output from the gate driving block 160. Thus, the initial pixel voltages charging the first to N/2-th horizontal lines are each maintained for a time 'B' which is the length of one second portion 'B' of a frame period, and then the initial pixel voltages decrease line after line to the compensation pixel voltages in response to the first to N/2-th compensation gate signals $C_1, \ldots, C_{N/2}$. The compensation pixel voltages are maintained for each line for a time equal to the second pulse width 'C'.

Thus, the compensation capacitor CCO reduces the initial pixel voltage charging the respective liquid crystal capacitor CLC to the compensation pixel voltage during the third portion 'C' of a relevant frame period, i.e. when the corresponding second switching element TFT2 of the pixel structure is turned on by the respective compensation gate signal.

Figure 6A:
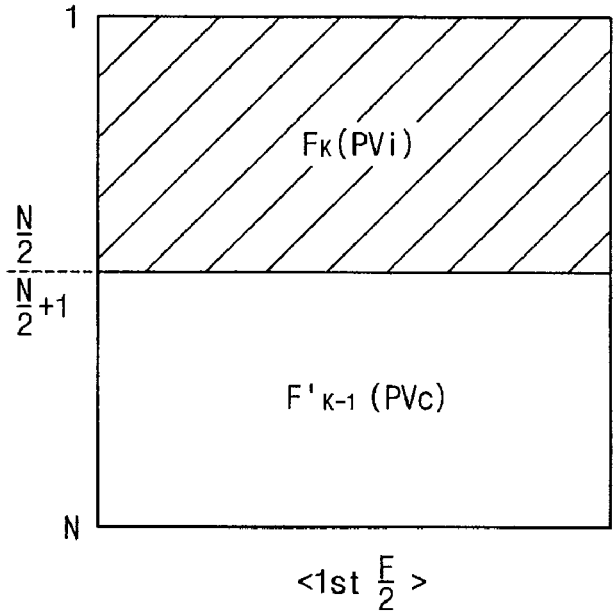
FIGS. 6A and 6B are schematic diagrams of images displayed on a display panel operated as in FIG. 5.
Figure 6B:
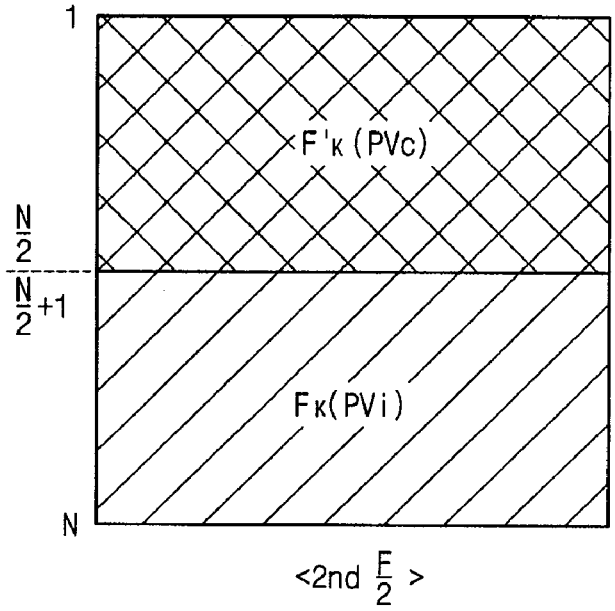

FIGS. 6A and 6B are schematic diagrams of images displayed on a display panel operated as in FIG. 5.

Referring to FIGS. 5 and 6A, during the first half "1st F/2" of frame period "FRAME K" starting on the rising edge of the gate signal G1 for a frame K, the first N/2-th horizontal lines 1, . . . , N/2 of the display panel 140 are charged to the initial pixel voltages PVi corresponding to the K-th frame's data. Accordingly, the upper half of the display panel 140 displays the K-th frame's normal image $F_K$. At this time, the bottom N/2 horizontal lines (N/2)+1, . . . , N are still charged with the compensation pixel voltages PVc corresponding to the data of frame (K-1). Accordingly, the lower half of the display panel 140 displays the compensation image $F'_{K-1}$ of frame (K-1).

Referring to FIGS. 5 and 6B, during the second half "2nd F/2" of the K-th frame period "FRAME K", the compensation gate driving block 170 operates to reduce the voltages on the first N/2 horizontal lines 1, . . . , N/2 from the initial pixel voltage values PVi to the compensation pixel voltages PVc. Accordingly, the upper half of the display panel 140 displays the compensation image $F'_K$ for the K-th frame.

On the other hand, the last N/2 horizontal lines (N/2)+1, . . . , N are charged to the initial pixel voltages PVi corresponding to the K-th frame's data. Accordingly, the lower half of the display panel 140 displays the normal image $F_K$ for the K-th frame.

The brightness of the compensation image $F'_K$ is lower than that of the normal image $F_K$. If the compensation image $F'_K$ is displayed longer, the brightness of the image displayed on the display panel 140 is lower. Accordingly, the brightness of the image displayed on the display panel 140 may be controlled by adjusting the length of the period when the compensation image $F'_K$ is displayed.

The ratio of the period when the normal image $F_K$ is displayed to the period when the compensation image $F'_K$ is displayed is 1:1 in some embodiments, and lower and higher ratios can also used.

As described above, in some embodiments of the present invention, a pixel structure includes a compensation gate line and a switching element that is to be turned on by a compensation gate signal applied to the compensation gate line, so that an initial pixel voltage charging the pixel structure is lowered to a compensation pixel voltage to eliminate a motion blur.

Thus, a slight modification of the conventional pixel structure (i.e. addition of the compensation line) makes it possible to easily reduce or eliminate the motion blur of a moving image. Some embodiments of the present invention achieve motion blur improvement at lower frequencies than prior art. For example, in some embodiments of the present invention, a 60 Hz (Hertz) operation provides motion blur compensation comparable to the motion blur compensation achieved at 120 Hz and higher frequencies in prior art.

Although exemplary embodiments in accordance with the present disclosure of invention have been described, it is understood that the present teachings should not be limited to these exemplary embodiments but that in light of the foregoing, various changes and modifications can be made by one of ordinary skilled in the art that are within the spirit and scope of the present teachings.

What is claimed is:

1. A display panel comprising:

a plurality of pixel structures disposed between plural gate lines, plural data lines crossing with the gate lines and plural compensation gate lines, each pixel structure being configured to display a corresponding image pixel and each pixel structure including:

a first switching element coupled to receive a gate signal from a corresponding one of the gate lines and coupled to receive an image pixel defining data signal from a corresponding one of the data lines;

a liquid crystal capacitor connected to the first switching element so as to be charged with an initial pixel voltage corresponding to the data signal when the first switching element is selectively turned on; and a voltage lowering part coupled to the liquid crystal capacitor and configured to selectively lower but not extinguish a voltage of the liquid crystal capacitor so as to thus lower but not black out a luminance of the image pixel in response to a compensation gate signal provided to the voltage lowering part by a corresponding one of the compensation gate lines, wherein the voltage lowering part of each pixel structure comprises:

a second switching element responsive to the compensation gate signal provided by the corresponding compensation gate line; and a compensation capacitor connected to the second switching element and to the liquid crystal capacitor so as to reduce the liquid crystal capacitor's voltage when the second switching element is turned on.

2. The display panel of claim 1, wherein the first switching element comprises:

a first gate electrode electrically connected to the gate line;

a first source electrode electrically connected to the data line; and a first drain electrode electrically connected to respective first plate terminals of the liquid crystal capacitor and of the compensation capacitor.

3. The display panel of claim 2, wherein the second switching element comprises:

a second gate electrode electrically connected to the compensation gate line;

a second source electrode electrically connected to a second plate terminal of the compensation capacitor; and a second drain electrode electrically connected to a second plate terminal of the liquid crystal capacitor.

4. The display panel of claim 3, wherein each pixel structure includes a storage capacitor and wherein the second drain electrode of the second switching element is connected with a second plate terminal of the storage capacitor, where an opposed first plate terminal of the storage capacitor is connected to the first plate terminal of the liquid crystal capacitor.

5. A display device comprising:

a display panel comprising:

a plurality of pixel structures disposed between plural gate lines, plural data lines crossing with the gate lines and plural compensation gate lines, each pixel structure being configured to display a corresponding image pixel and each pixel structure including:

a first switching element including two first input terminals and a first output terminal, the two first input terminals being connected to a corresponding one of the gate lines and a corresponding one of the data lines respectively;

a liquid crystal capacitor including a driving electrode and a common electrode, the driving electrode being connected to the first output terminal of the first switching element; and a voltage lowering part that lowers a voltage of the liquid crystal capacitor to thereby lower a luminance of an image pixel produced by the pixel structure, where the voltage lowering part is responsive to a compensation gate signal provided to the voltage lowering part by a corresponding one of the compensation gate lines and where the voltage lowering part is configured to selectively lower but not extinguish a voltage of the liquid crystal capacitor so as to thus lower but not black out a luminance of the image pixel in response to the compensation gate signal delivered by said compensation gate line;

a source driving block for outputting data signals to corresponding ones of the data lines;

a gate driving block for outputting gate signals to corresponding ones of the gate lines; and a compensation gate lines driving block for outputting compensation gate signals to corresponding ones of the compensation gate lines, where the output compensation gate signals are delayed by predetermined durations relative to the corresponding gate signals, wherein the voltage lowering part comprises:

a compensation capacitor connected so as to being selectively coupled in parallel with the liquid crystal capacitor; and a second switching element including two second input terminals and a second output terminal, the two second input terminals being connected to the compensation capacitor and a corresponding one of the compensation gate lines respectively, and the second output terminal being connected to the common electrode of the liquid crystal capacitor.

6. The display device of claim 5, wherein the gate driving block is configured to output turning-on gate signals to respective ones of the gate lines during a first portion of a frame period.

7. The display device of claim 6, wherein the first portion of the frame period is a horizontal period (1H).

8. The display device of claim 6, wherein the first switching element charges the liquid crystal capacitor with an initial pixel voltage during the first portion of the frame period in response to the gate signal.

9. The display device of claim 6, wherein each pixel structure of the display panel further comprises a storage capacitor connected to the first output terminal of the first switching element, wherein the storage capacitor is connected in parallel with the liquid crystal capacitor.

10. The display device of claim 9, wherein the liquid crystal capacitor is charged with an initial voltage during the first portion of the frame period, and the storage capacitor maintains the initial voltage during a second portion of the frame period, the second portion of the frame period corresponding to a period between respective turning ons of the gate signal and the compensation gate signal.

11. The display device of claim 10, wherein the compensation gate driving block outputs the compensation gate signals to the compensation gate lines during a third portion of the frame period.

12. The display device of claim 11, wherein the liquid crystal capacitor is charged with an initial pixel voltage during the first portion of the frame period, and the compensation capacitor lowers the liquid crystal capacitor's voltage from the initial pixel voltage to a compensation pixel voltage during the third portion of the frame period when the second switching element is turned on in response to the compensation gate signal.

13. A method of driving a display device including a display panel comprising a plurality of pixel structures disposed between plural gate lines, plural data lines crossing with the gate lines and plural compensation gate lines, each pixel structure being configured to display a corresponding image pixel and each pixel structure including: a first switching element including two first input terminals connected respectively to a gate line and a data line, a liquid crystal capacitor including a first plate electrode connected to a first output terminal of the first switching element, a compensation capacitor connected for selective connection in parallel with the liquid crystal capacitor, and a second switching element including two second input terminals, a first of which is connected respectively to the compensation capacitor and a second of which is connected respectively to a corresponding one of the compensation gate lines, the second switching element further including a second output terminal connected to a second plate electrode of the liquid crystal capacitor, the method comprising:

outputting data signals to corresponding ones of the data lines;

outputting gate signals to corresponding ones of the gate lines; and outputting compensation gate signals to corresponding ones of the compensation gate lines, where the compensation gate signals are delayed by predetermined durations relative to their corresponding gate signals, wherein the outputting of the compensation gate signals includes:

turning on the second switching element in response to the compensation gate signal; and reducing voltage across the liquid crystal capacitor from the initial pixel voltage to a nonzero compensation pixel voltage by drawing charge to the compensation capacitor when the second switching element is turned on.

14. The method of claim 13, wherein the gate signal is output during a first portion of a frame period.

15. The method of claim 14, wherein the first portion of the frame period is a horizontal period (1H).

16. The method of claim 14, wherein outputting the gate signal includes:

turning on the first switching element in response to the gate signal; and charging the liquid crystal capacitor with the initial pixel voltage corresponding to the data signal when the first switching element is turned on.

17. The method of claim 16, further comprising maintaining the initial pixel voltage for a predefined length of time after ceasing to output the gate signal.

18. The method of claim 17, wherein the compensation gate signal is output for a predefined length of time during the frame period.

* * * * *